United States Patent [19]

Schmitt

[11] Patent Number: 4,485,669

[45] Date of Patent: Dec. 4, 1984

[54] DEVICE FOR DETERMINING THE TIMELY DELIVERY OF COMPRESSED GAS FROM COMPRESSED-GAS CONTAINERS

[75] Inventor: Josef Schmitt, Dänischhagen, Fed. Rep. of Germany

[73] Assignee: Krupp MaK Maschinenbau GmbH, Kiel, Fed. Rep. of Germany

[21] Appl. No.: 448,676

[22] Filed: Dec. 10, 1982

[30] Foreign Application Priority Data

Dec. 31, 1981 [DE] Fed. Rep. of Germany ..... 3152013

[51] Int. Cl.[3] ..... G01L 23/00

[52] U.S. Cl. ..... 73/167; 73/168; 73/432.1

[58] Field of Search ..... 73/149, 714, 861, 861.42, 73/49.2, 37, 11, 168, 167, 432 R

[56] References Cited

U.S. PATENT DOCUMENTS

| | | | |
|---|---|---|---|
| 3,744,306 | 7/1973 | Krueger | 73/149 |
| 3,875,801 | 4/1975 | Bishaf | 73/714 |
| 4,078,421 | 3/1978 | Gastaldo | 73/49.2 |
| 4,285,245 | 8/1981 | Kennedy | 73/861 |
| 4,364,413 | 12/1982 | Bersin | 73/861 |

*Primary Examiner*—Herbert Goldstein
*Attorney, Agent, or Firm*—John C. Smith, Jr.

[57] ABSTRACT

A device for determining the timely delivery of compressed gas from compressed-gas containers for ejection and discharge tubes of submarines in which the compressed gas is suppliable via a system-controlled blow-out valve comprising a compressed-gas container having a pressure pick-off with a pressure gauge and a converter for producing an electrical signal representing the actual pressure value. Upper and lower desired pressure values in the form of electrical signals are adjustable on transmitters electrically connected to separate comparator stages to which the electrical signal of the actual pressure value and, in each case, one of the signals of the adjusted predetermined values are supplied and by which a timing member having a running time indicator is controlled. The timing member is started when the pressure in the compressed-gas container falls below the adjusted upper pressure value and is stopped when the pressure in the compressed-gas container reaches the adjusted lower pressure value.

4 Claims, 2 Drawing Figures

DEVICE FOR DETERMINING THE TIMELY DELIVERY OF COMPRESSED GAS FROM COMPRESSED-GAS CONTAINERS

BACKGROUND OF THE INVENTION

This invention relates to a device for determining the timely delivery of compressed gas from compressed-gas containers for ejection and discharge tubes of submarines in which the compressed gas is suppliable via a system-controlled blowout valve.

In such arrangements the blowout valve, besides the actual opening function, must also fulfill a control function in order to eject the weapons in all submersion depths with predetermined speeds. Hence, it is necessary to greatly vary the throughput and thus the cross section of the outlet of the blowout valve in adaptation to the submersion depth in order to chose the characteristic of the compressed-gas delivery.

A control and measurement of the respectively adjusted course of the delivery of compressed gas from the compressed-gas container, in particular after servicing operations, is up to now only possible with the aid of an expensive measuring technique and therefore is hardly suitable for a quick testing in practice.

SUMMARY OF THE INVENTION

It is, therefore, the object of the present invention to avoid the above-mentioned disadvantages and to provide a device for determining the timely delivery of compressed gas from compressed-gas containers which makes apparent the function of the blowout valve and the rate of discharge in a simple manner.

To attain this object the present invention provides a device for determining the timely delivery of compressed gas from compressed-gas containers for ejection and discharge tubes of submarines in which the compressed gas is suppliable via a system-controlled blowout valve, comprising a compressed-gas container having a pressure pick-off with a pressure gauge and a converter for producing an electrical signal representing the actual pressure value; transmitters at which an upper and a lower desired pressure value in the form of electrical signals are adjustable, and separate comparator stages to which the electrical signal of the actual pressure value and in each case one of the signals of the adjusted desired pressure values are supplied and by which a timing member having a running time indicator is controlled in such a manner that the timing member is started when the pressure in the compressed-gas container falls below the adjusted upper pressure value and is stopped when the pressure in the compressed-gas container reaches the adjusted lower pressure value.

By this arrangement it is possible to determine without great expense the time slope of the mass throughput, the pressure drop within the compressed-gas container being relied upon for this purpose.

Alternatively, it is proposed by the invention to form the desired value for a stop pulse by an adjustable timing member. In this case the determined pressure in connection with the two adjusted desired values for the time interval and the pressure from which the time interval is measured, is a measure for the function of the blowout valve and the discharge rate.

A favorable range of measurement is one in which the upper pressure value is in a region above 90% and the lower pressure value is in a region of about 50% to 70% of the filling pressure of the compressed-gas container.

BRIEF DESCRIPTION OF THE DRAWINGS

Two embodiments of the invention will now be described by way of example and with reference to the accompanying drawings in which.

DESCRIPTION OF THE PREFERRED EMBODIMENTS

Figure 1:
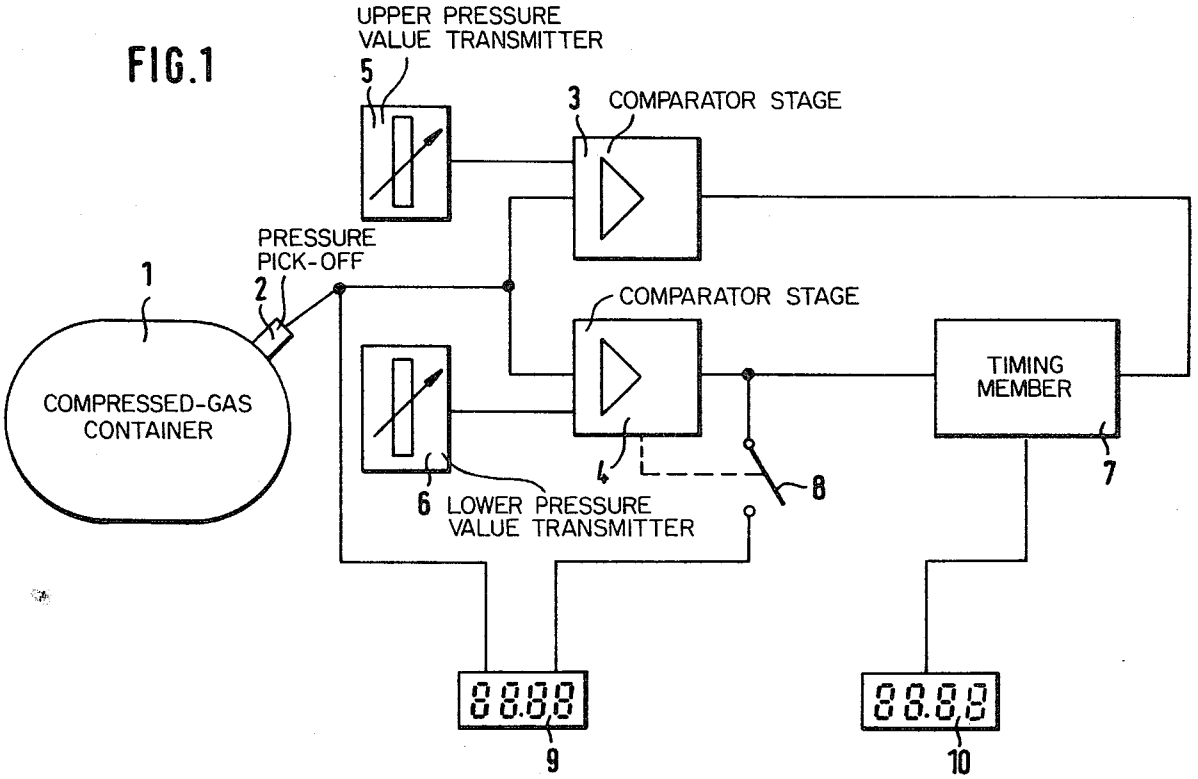
FIG. 1 shows a circuit arrangement with a formation of a desired value by means of an upper and a lower pressure value.

FIG. 1 shows a compressed-gas container 1 comprising a pressure pick-off 2 which, on the one hand, produces via a converter (not shown) an electrical signal and, on the other hand, is connected to a pressure gauge 9. A circuit network for a system-controlled blowout valve is not illustrated. For adjusting the upper and lower pressure values transmitters 5 and 6 are provided which as set-value transmitters preset a desired pressure value as an electrical signal. The electrical signal of the transmitters 5 and 6 is supplied to separate comparator stages 3 and 4 and compared with the electrical signal which arrives from the pressure pick-off 2 and represents the actual pressure value.

When the pressure in the compressed-gas container 1 falls below the set upper pressure value of the transmitter 5, the comparator stage 3 provides a starting pulse to a timing member 7. When after a certain period of time the set pressure value of the transmitter 6 is reached, the comparator stage 4 provides a stop pulse to the timing member 7 and detects in this case via a switch 8 the pressure which is present at this time in the compressed-gas container 1. This pressure is shown at the pressure gauge 9, the associated running time being able to be seen from an indicator 10. The gained indication of the running time in connection with the indication of the pressure or the set lower pressure value represents a measure for the rate of flow from the compressed-gas container 1 and makes possible the control of the adjusted blowout valve.

Figure 2:
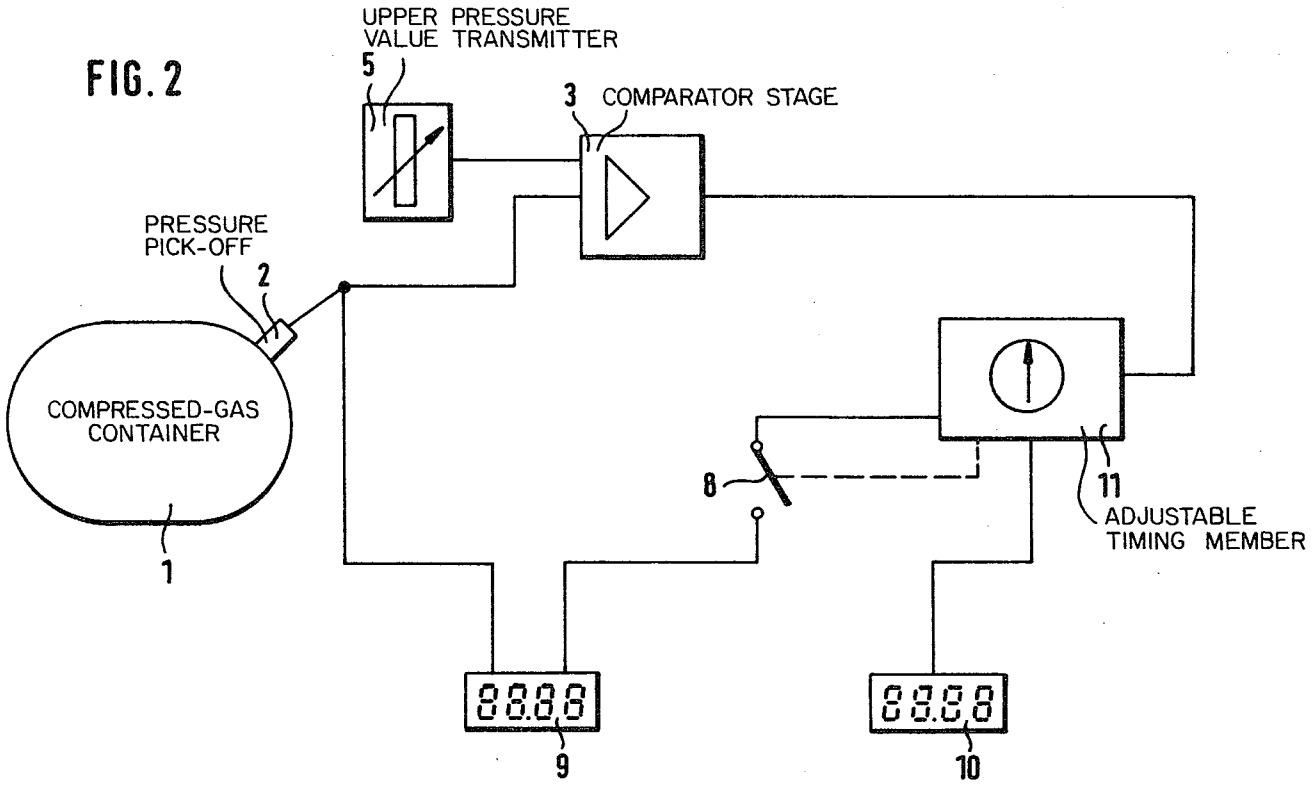
FIG. 2 shows a circuit arrangement with a formation of the desired value by means of an upper pressure value and an adjustable timing member.

When falling below an upper pressure value according to FIG. 2 an adjustable timing member 11 is put into operation via the comparator stage 3. After a preset time interval this timing member 11 transmits via the switch 8 a signal to the pressure gauge 9 which runs along with the pressure in the compressed-gas container 1. Thereby, the pressure indicated at the pressure gauge 9 is detected at the moment of switching and is in connection with the set time interval at the timing member 11 and the switching pressure at the comparator stage 3 a measure for the rate of flow and the function of the blowout valve.

Preferably, the upper pressure value is in a region above 90% and the lower pressure value is in a region of about 50% to 70% of the filling pressure of the compressed-gas container.

The invention may be embodied in other specific forms without departing from the spirit or essential characteristics thereof. The embodiments are therefore to be considered in all respects as illustrative and not restrictive.

What is claimed is:

1. In a submarine subjected to variations in submersion depths, a device for determining the timely delivery of compressed gas from a compressed-gas container for ejection and discharge tubes in which the compressed gas is supplied via a system-controlled blowout valve comprising:

(a) a compressed-gas container having a pressure pick-off with a pressure gauge and a converter for producing an electrical signal representing the actual pressure value;

(b) a pair of adjustable transmitters arranged for setting predetermined upper and lower pressure values, respectively, and for generating electrical signals corresponding to said predetermined upper and lower pressure values, respectively;

(c) a pair of comparator stages and means connecting said respective comparator stages to respective of said adjustable transmitters and to said pressure pick-off such that one of said comparator stages receives said electrical signal corresponding to said predetermined upper pressure value and said electrical signal corresponding to said actual pressure value and the other of said comparator stages receives said electrical signal corresponding to said predetermined lower pressure value and said electrical signal corresponding to said actual pressure value;

(d) said one comparator stage being adapted to generate an electrical signal when said actual pressure value falls below said predetermined upper pressure value and said other comparator stage being adapted to generate an electrical signal when said actual pressure value is reduced to said predetermined lower pressure value; and (e) a timing member having a running time indicator and means connecting said timing member to each of said comparator stages such that said timing member receives said respective electrical signals from said comparator stages;

(f) said timing member being adapted to start measuring elapsed time upon receiving a signal from said one comparator stage and to stop measuring said elapsed time upon receiving a signal from said other comparator stage and to indicate said elapsed time;

(g) whereby the elapsed time for the pressure in said compressed-gas container to drop from said predetermined upper pressure value to said predetermined lower pressure value is indicated.

2. In a submarine as defined in claim 1 wherein said upper pressure value is in a region above 90% and said lower pressure value is in a region of about 50–70% of the filling pressure of said compressed-gas container.

3. In a submarine subjected to variations in submersion depths, a device for determining the timely delivery of compressed gas from a compressed-gas container for ejection and discharge tubes in which the compressed gas is supplied via a system-controlled blowout valve comprising:

(a) a compressed-gas container having a pressure pick-off with a pressure gauge and a converter for producing an electrical signal representing the actual pressure value;

(b) an adjustable transmitter arranged for setting a predetermined upper pressure value and for generating an electrical signal corresponding to said predetermined upper pressure value;

(c) a comparator stage and means connecting said comparator stage to said adjustable transmitter and to said pressure pick-off such that said comparator stage receives said electrical signal corresponding to said predetermined upper pressure value and said electrical signal corresponding to said actual pressure value;

(d) said comparator stage being adapted to generate an electrical signal when said actual pressure value falls below said predetermined upper pressure value;

(e) an adjustable timing member having a running time indicator and arranged for setting a predetermined time period and means connecting said adjustable timing member to said comparator stage;

(f) said timing member being adapted to initiate said predetermined time period upon receiving said electrical signal from said comparator stage when said actual pressure value falls below said predetermined upper pressure value; and (g) means connecting said adjustable timing member to said pressure gauge;

(h) said adjustable timing member being adapted to generate an electrical signal at the end of said predetermined time period to hold said pressure gauge at the actual pressure value at termination of said time period;

(i) whereby the drop in the actual pressure value in said compressed-gas container during said predetermined time period is indicated.

4. In a submarine as defined in claim 1 wherein said upper pressure value is in a region above 90% and said lower pressure value is in a region of about 50–70% of the filling pressure of said compressed-gas container.

* * * * *